US010712017B2

(12) United States Patent
Buchmann et al.

(10) Patent No.: US 10,712,017 B2
(45) Date of Patent: Jul. 14, 2020

(54) HOUSEHOLD APPLIANCE

(71) Applicant: BSH Hausgeräte GmbH, Munich (DE)

(72) Inventors: Jérémy Buchmann, Lipsheim (FR); Jürgen Desor, Strasbourg (DE)

(73) Assignee: BSH Hausgeräte GmbH, Munich (DE)

( * ) Notice: Subject to any disclaimer, the term of this patent is extended or adjusted under 35 U.S.C. 154(b) by 169 days.

(21) Appl. No.: 16/060,570

(22) PCT Filed: Nov. 15, 2016

(86) PCT No.: PCT/EP2016/077666
§ 371 (c)(1),
(2) Date: Jun. 8, 2018

(87) PCT Pub. No.: WO2017/097546
PCT Pub. Date: Jun. 15, 2017

(65) Prior Publication Data

US 2018/0363918 A1 Dec. 20, 2018

(30) Foreign Application Priority Data

Dec. 10, 2015 (EP) ..... 15290306

(51) Int. Cl.
*F24C 15/02* (2006.01)
*A47L 15/42* (2006.01)

(52) U.S. Cl.
CPC ..... *F24C 15/023* (2013.01); *A47L 15/4261* (2013.01); *E05Y 2900/308* (2013.01)

(58) Field of Classification Search
CPC ..... A47L 15/4261; F24C 15/023
USPC ..... 126/191
See application file for complete search history.

(56) References Cited

U.S. PATENT DOCUMENTS

| | | | | |
|---|---|---|---|---|
| 2,256,649 | A | 9/1941 | Rawlings | |
| 2,911,667 | A * | 11/1959 | Burke | E05F 1/1261 16/290 |
| 4,862,758 | A * | 9/1989 | Magee | A01B 73/044 74/103 |
| 2008/0201907 | A1 | 8/2008 | Vanini | |
| 2015/0354261 | A1* | 12/2015 | Dora | E05F 15/616 49/31 |
| 2016/0251793 | A1 | 9/2016 | Finney et al. | |

FOREIGN PATENT DOCUMENTS

| | | | |
|---|---|---|---|
| CN | 101660377 | A | 3/2010 |
| CN | 101982344 | A | 3/2011 |
| CN | 102853730 | A | 1/2013 |
| DE | 3243865 | A1 | 5/1984 |

(Continued)

OTHER PUBLICATIONS

National Search Report CN 201680072195.8 dated Jan. 16, 2019.

(Continued)

*Primary Examiner* — Avinash A Savani
(74) *Attorney, Agent, or Firm* — Michael E. Tschupp; Andre Pallapies; Brandon G. Braun

(57) ABSTRACT

A household appliance includes a processing chamber having a front loading opening, a door, and hinges to join the door to a remaining structure of the household appliance and to enable the door to horizontally pivot for closing the loading opening. At least one of the hinges is floatingly joined to the remaining structure of the household appliance.

12 Claims, 5 Drawing Sheets

(56) References Cited

FOREIGN PATENT DOCUMENTS

| | | | |
|---|---|---|---|
| DE | 29813106 | U1 | 10/1998 |
| DE | 10323977 | A1 | 12/2004 |
| DE | 102008/041494 | A1 | 3/2010 |
| DE | 102009029545 | A1 | 3/2011 |
| DE | 102011001810 | A1 | 10/2012 |
| EP | 1055881 | A2 | 11/2000 |
| EP | 1055882 | B1 | 4/2005 |
| EP | 2586332 | A1 | 5/2013 |
| EP | 2620576 | A2 | 7/2013 |
| EP | 2093493 | B1 | 2/2016 |
| WO | 2014177134 | A3 | 12/2014 |

OTHER PUBLICATIONS

International International Search Report PCT/EP2016/077666 dated Jan. 12, 2017.
Report of Examination EP 16 795 083.1 dated Jul. 25, 2019.

* cited by examiner

HOUSEHOLD APPLIANCE

CROSS-REFERENCES TO RELATED APPLICATIONS

This application is the U.S. National Stage of International Application No. PCT/EP2016/077666, filed Nov. 15, 2016, which designated the United States and has been published as International Publication No. WO 2017/097546 A1 and which claims the priority of European Patent Application, Serial No. 15290306.8, filed Dec. 10, 2015, pursuant to 35 U.S.C. 119(a)-(d).

BACKGROUND OF THE INVENTION

The invention relates to a household appliance that has a processing chamber with a front loading opening and a horizontally pivoting door for closing the loading opening, which door is joined to the remaining household appliance by hinges. The invention can be particularly advantageously applied to cooking appliances, in particular ovens with a horizontally pivoting oven door.

In the case of ovens, horizontal hinges are known for horizontally opening oven doors, that are anchored both in a frame of the oven and also in a door leaf. A disadvantage is that distance tolerances caused by production which arise between an oven front and the door leaf are not balanced. The results of endurance tests have shown that when hinges are installed under tension, component wear of the mechanically moving parts found in the hinge is very high and can result in emissions of noise and even failures at an early stage. Particularly affected by this are guide rollers, axles and sliding systems that no longer withstand the increased stresses on one side. The hinges can for example be tensioned due to mounting tolerances and/or component tolerances, e.g. due to a door bent out of its door plane.

DE 10 2008 010 523 A1 discloses a household appliance apparatus with a household appliance door and at least one household appliance door mounting unit which mounts the household appliance door so that it can pivot about an axis. To achieve coordinated mobility of the household appliance door, it is proposed that the household appliance apparatus has at least one locking unit which is provided to fix the household appliance door mounting unit in at least one pivot position.

DE 199 23 994 A1 discloses a household appliance hinge apparatus with locking surfaces which hold the door in a horizontal open position counter to a spring door closing force, even if a glass plate of the door is removed for cleaning, wherein however the retaining force can be overcome by a manual force exerted on the door in the closing direction.

DE 199 23 996 A1 discloses a household appliance hinge apparatus with a damping means for damping a collision of stop surfaces.

EP 1 961 901 B1 discloses a hinge for wings or doors, in particular of electrical appliances, comprising a first element and a second element, a lever for connecting the first and second elements, the lever pivoting on the second element by means of a pin rendering the first and second elements movable relative to one another with a tilting action, wherein the first and second elements can be fixed, one to a frame and the other to a wing or door, so that the wing or door can move relative to the frame between a closed position and an open position, wherein the second element is box-shaped and contains elastic means connected to the lever by a rod which slides inside the second box-shaped element, wherein the hinge further comprises friction means for applying a braking action to the reciprocal sliding of the rod relative to the second box-shaped element, wherein the friction means comprises a friction element inserted between the rod and the second box-shaped element and connected to the latter, wherein the second box-shaped element comprises two walls extending longitudinally opposite one another, wherein the hinge is characterized in that the opposite longitudinal walls of the second box-shaped element comprise respective recesses forming a zone for housing the friction element, wherein the friction element does not apply any friction to the longitudinal walls in the zone.

EP 2 620 576 A2 discloses a hinge mechanism which has a friction system in the interior which is used in oven doors. This friction system helps the door to stay in a balanced position during opening and closing with the aid of the friction force.

BRIEF SUMMARY OF THE INVENTION

It is the object of the present invention to overcome the disadvantages of the prior art at least partially and in particular to provide a hinge, in particular a heavy-duty horizontal hinge, for household appliances which can balance tolerances and differences in flatness between an associated door and the remaining household appliance in a simple manner.

This object is achieved with the features of the independent claims. Preferred embodiments are described in particular in the dependent claims.

The object is achieved by a household appliance having a processing chamber with a front loading opening and a horizontally pivoting door for closing the loading opening, which door is joined to the remaining household appliance by hinges, wherein at least one of the hinges is floatingly joined to the remaining household appliance.

The advantage of this is that tensions and sharp increases in wear and tear of movable parts in the hinge can be cushioned in a very simple and robust manner and mounting can be simplified. In particular the distance tolerances between the door and the remaining household appliance, which arise for example due to component tolerances and mounting tolerances, can be easily balanced. Endurance tests have shown that the household appliance can now readily withstand several tens of thousands of cycles, without traces of wear and tear or noise caused by abrasion arising.

"Remaining household appliance" can be understood in particular as the household appliance excluding the door and hinges.

A processing chamber can be understood in particular as a chamber for processing (e.g. cooking, refrigerating, washing) items (foods, laundry, crockery, etc.) introduced by a user.

The hinges are typically arranged on the left and right next to the loading opening, if appropriate offset at least partially downward.

A floating connection can be understood in particular as a connection in which the hinges are fixed movably or with a predefined clearance to the remaining household appliance at least in the lateral direction (e.g. in a front view of the household appliance to the left, right, downward and/or upward). The hinges can thereby vary or adjust their distance and/or their height position to one another, in response to the component tolerances and mounting tolerances. The mobility in the lateral direction can comprise rotary mobility to enable swinging back and forth and/or linear mobility to enable a lateral displacement.

One embodiment is for the hinges to be suspended floatingly on the remaining household appliance. The hinges, in particular the hinge casing thereof, are thereby freely suspended and can adjust themselves to an actual door position in particular by swinging back and forth or rotating. This enables the hinges to be designed and mounted particularly easily.

Another embodiment is for the hinges to be slotted or have a slot on their underside or end underside and to be fitted there without support in the remaining household appliance. The slot can, in particular if it extends in a lateral direction or transverse direction, advantageously prevent a movement forward (frontally out of the household appliance) and/or backward (frontally into the household appliance). This can in turn prevent a rotation and where appropriate bending of the hinge about a horizontal, laterally extending axis. The absence of support means that a lateral movement is not prevented in practice. Furthermore the slot can serve as a mounting aid.

In another embodiment the hinges are fitted in a front panel by their slotted underside or the slot on the underside. This enables them to be fitted with ease and nevertheless robustly. Since a corresponding edge of the front panel runs laterally horizontally, few if any adjustments to the fitting are required.

A further embodiment is for the hinges to be joined to a frame of the household appliance. The frame advantageously offers high stability and rigidity and also runs at the places at which hinges are normally positioned.

One development is for the hinges to be joined to the door, in particular to a door leaf, via their hinge arm.

Another embodiment is for the hinges to be freely suspended on a fixing screw fixed to the frame. This enables suspension to take place particularly simply and inexpensively. Alternatively the hinges can also be suspended by means of at least one other suspension element such as a pin, bolt, hook, etc.

Another embodiment is for at least one hinge to have a round hole, via which it is joined to the remaining household appliance. Thus the hinge can perform a swinging movement, without being displaced laterally horizontally against the remaining household appliance. This enables particularly simple suspension and precise positioning of the hinge. Thus by means of the round hole at least one of the two hinges can balance horizontal tolerances, in that it can be pivoted laterally.

An additional or alternative embodiment is for at least one hinge to have a horizontal oblong hole, via which it is joined to the remaining household appliance. Thus the hinge can—for example in addition to a swinging movement—be displaced laterally horizontally against the remaining household appliance, which enables an even stronger adaptation even to greater tolerances, etc. Thus by means of the horizontal oblong hole at least one of the two hinges can balance horizontal tolerances, in that it slips in a lateral position.

Another embodiment is for a hinge to have the horizontal oblong hole, via which it is joined to the remaining household appliance, and for another hinge to have a round hole, via which it is joined to the remaining household appliance. Thus a strong adaptation even to greater tolerances can be achieved, wherein thanks to the round hole a parallel lateral displacement of the door is prevented.

One development is for the hinges to have at least one hole (e.g. round hole and/or oblong hole) to enable a fixing element (screw, bolt, etc.) to be led through in a tab-like subregion (called a "tab" without restriction of generality below) standing vertically upright from the hinge. This facilitates mounting.

Another development is for the tabs to represent an upwardly-bent subregion of a hinge casing. This enables the tabs to be manufactured particularly easily using a bending process. The hinge casing can be a sheet metal part, e.g. made of steel.

One development is for both an oblong hole and a round hole to be present in the tabs of at least one hinge, in particular of both hinges. Thus the hinges can optionally be suspended by a hole, which facilitates logistics and storage. The oblong hole and the round hole can be arranged vertically above one another and/or laterally next to one another.

Another embodiment is for the household appliance to be an electrically operated cooking appliance, for the processing chamber to be a cooking chamber and for the door to be a cooking chamber door. The invention can be employed particularly advantageously for cooking appliances, since these generally have a particularly heavy door, meaning that the hinges are subject to particular stress when the door is opened and closed. Even small tensions in the hinges can then have a significantly disadvantageous effect on the service life. The cooking appliance can comprise an oven. The oven can comprise a steam cooking and/or microwave functionality. The cooking appliance can also be a standalone steam cooking appliance.

However, the household appliance can also generally be a large household appliance, in particular a kitchen appliance, in particular "white goods". The household appliance can for example be a laundry care appliance (e.g. a washing machine and/or a tumble dryer, etc.), a dishwashing appliance (e.g. a dishwasher and/or a sterilizer, etc.), or a refrigeration appliance (e.g. a refrigerator or a freezer, etc.). However, it can also be a small household appliance such as a microwave oven, etc.

BRIEF DESCRIPTION OF THE DRAWINGS

The above-described properties, features and advantages of this invention and the manner in which these are achieved will now be described more clearly and intelligibly with an exemplary embodiment, illustrated in the following schematic description of an exemplary embodiment, which will be described in detail making reference to the drawings.

DETAILED DESCRIPTION OF EXEMPLARY EMBODIMENTS OF THE PRESENT INVENTION

Figure 1:
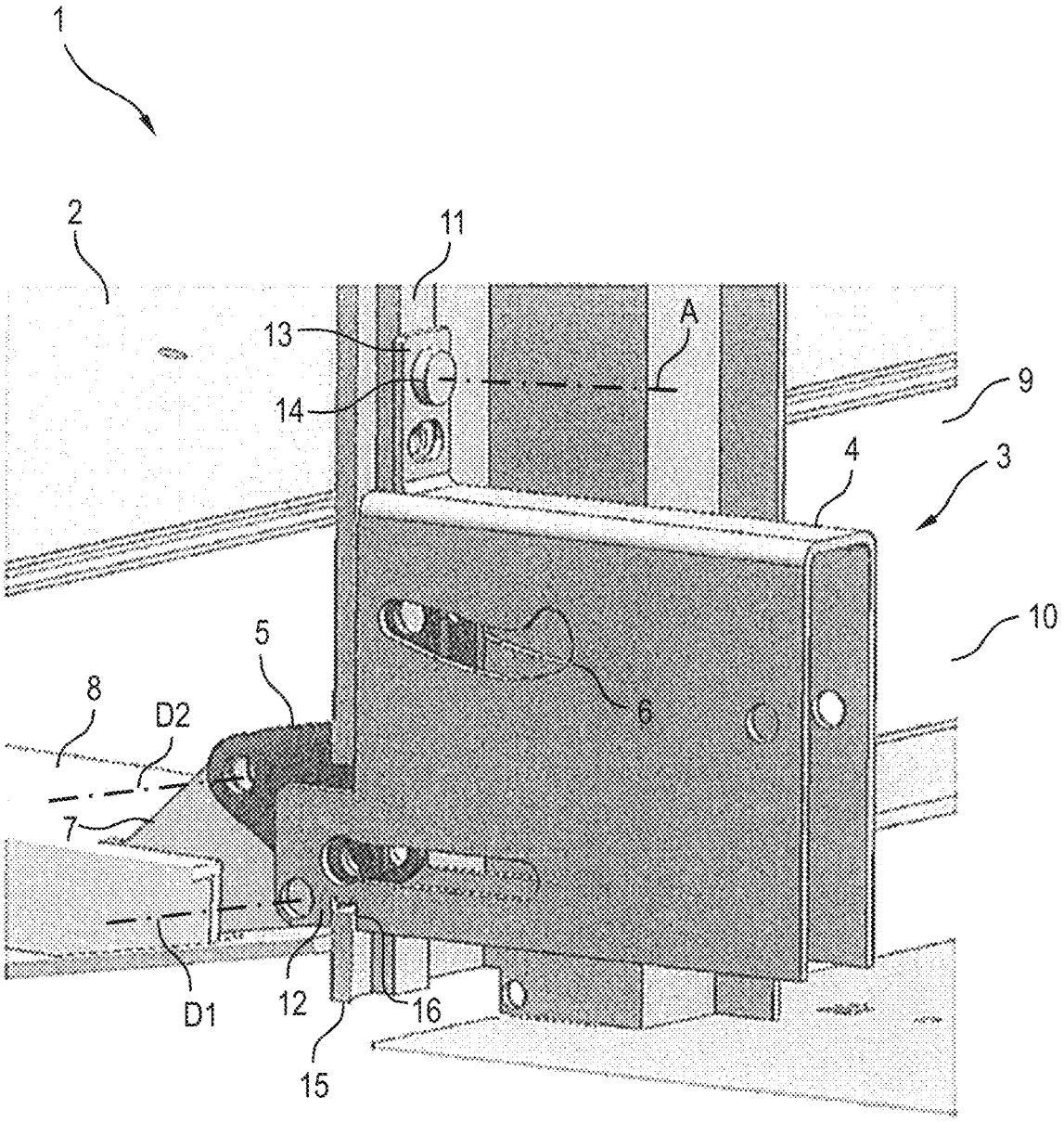
FIG. 1 shows a sectional view obliquely from behind of components of an oven with an open oven door.
Figure 2:
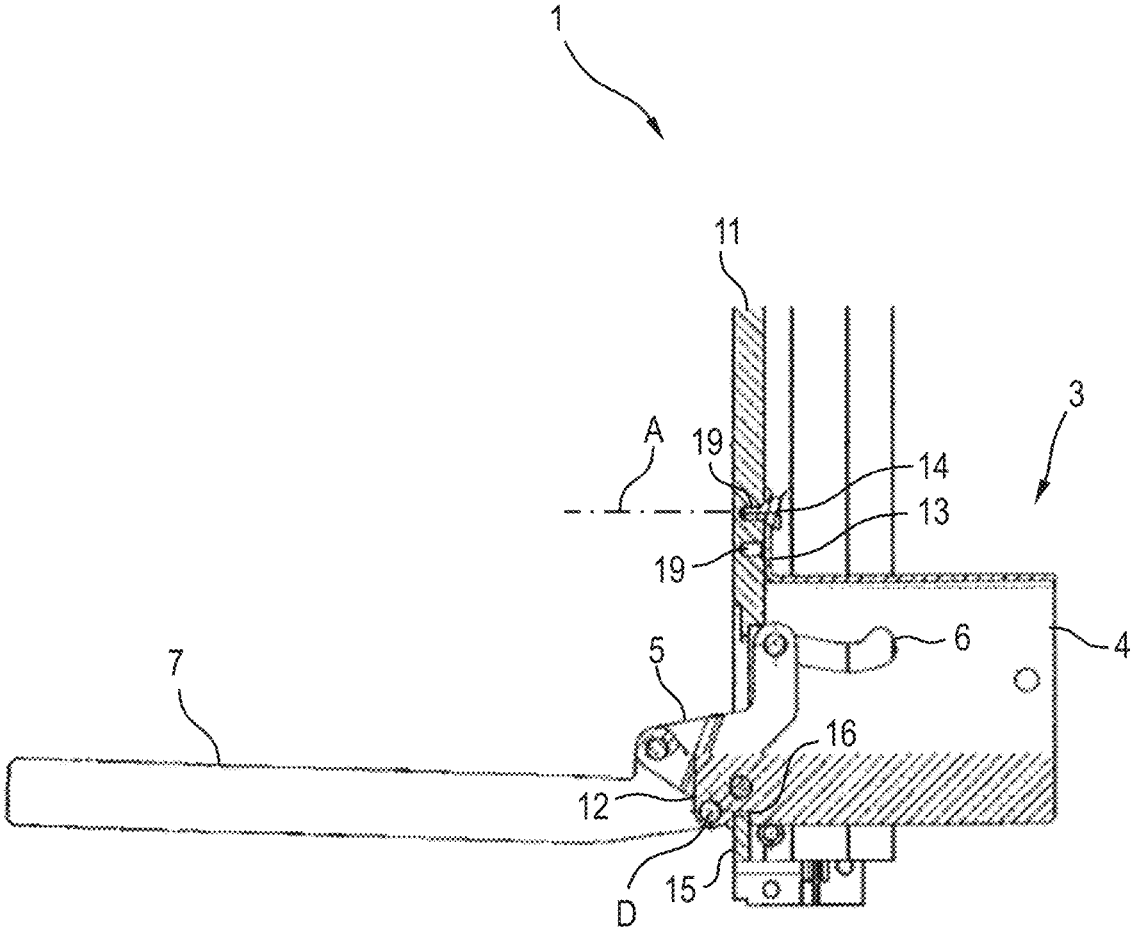
FIG. 2 shows a side view of a hinge fitted in the oven.

FIG. 1 shows a sectional view obliquely from behind of components of a household appliance in the form of an oven 1 with an open oven door 2. The oven door 2 can be pivoted by means of a hinge 3 about a horizontal first axis of rotation D1 extending laterally. To this end the hinge 3 has a hinge casing 4 made of sheet steel, in which a connection element (called a "deflection bracket" 5 below without restriction of generality) is inserted that can be displaced rotationally and/or longitudinally. The hinge casing 4 has a casing groove 6 to guide the deflection bracket 5. The deflection bracket 5 is rotatably joined by a hinge arm 7 via a second axis of rotation D2 to a subregion projecting from the front of the hinge casing 4. The hinge arm 7 is inserted into a door leaf 8 for connection to the oven door 2 and is rotatably joined to the hinge casing 4 at the first axis of rotation D1. The oven door 2 can close a front loading opening 9 of an oven chamber 10 serving as a processing chamber. FIG. 2 shows a side view of a hinge 3 fitted in the oven 1.

To join the oven door 2 to the remaining oven 1 the hinges 3 are fixed to a frame section, arranged at the front, of a frame 11 of the oven 1. The two frame sections of the frame 11 are arranged to the left and right of the loading opening 9. The rear of the hinge 3 rests on the frame 11, wherein the subregion of the deflection bracket 5 which is joined to the hinge arm 7 and a part 12, protruding on the front, of the hinge casing 4, through which the axis of rotation D1 also runs, project through a vertical longitudinal opening (not shown) in the frame 11 on the front in front of the frame 11.

Figure 3:
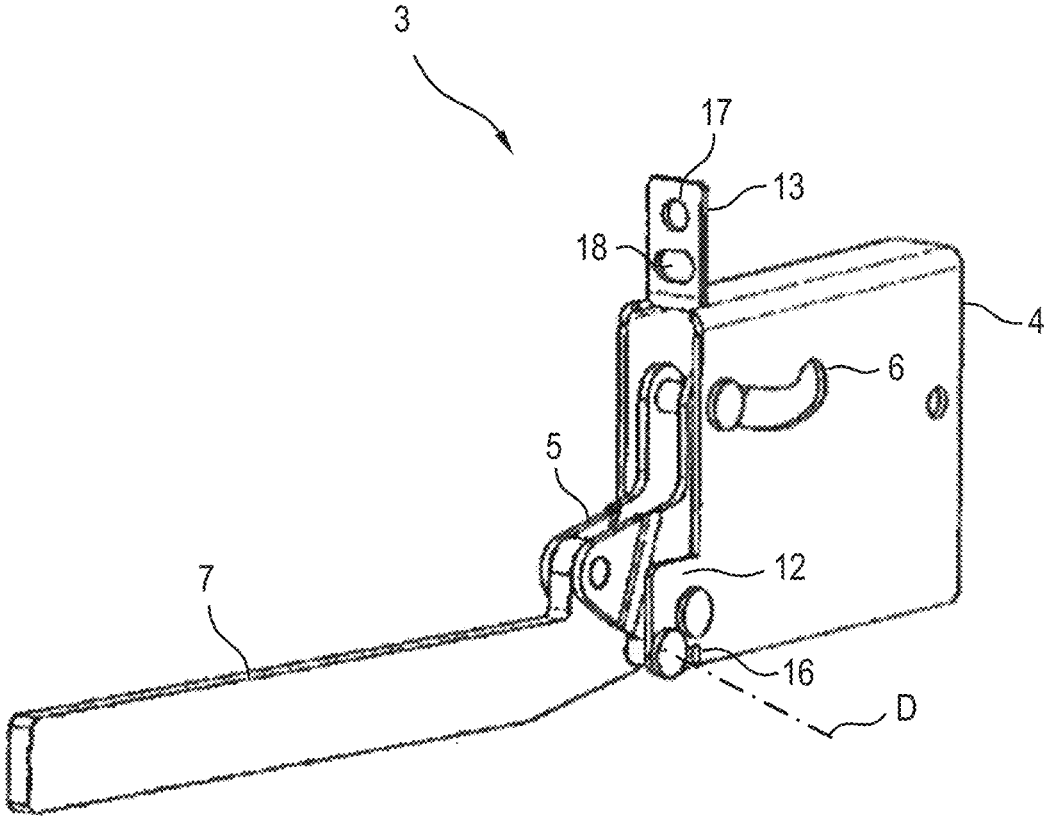
FIG. 3 shows a view obliquely from the front of the hinge in isolation.

The hinges 3 are freely rotatably joined to the frame 11 via tabs 13 on the front bent upward from a top of the respective hinge casing 4, here by means of screws 14 in each case. The hinges 3 do not rest on their underside, so that they are freely floatingly suspended on the frame 11. To this end the hinges 3 are slotted on their underside or have a slot 16 there and are fitted in a front metal sheet 15 there without support. The slot 16 on the underside is shown in more detail in FIG. 3. The absence of support means, now again in reference to FIG. 1 or FIG. 2, that the hinges 3 can at least swing back and forth or rotate about a vertical screw axis A (which is perpendicular to the axes of rotation D1 or D2) established by the screws 14.

To enable the screws 14 to be led through, the tab 13 has a round hole 17 and, arranged underneath this, a horizontally oriented oblong hole 18. A respective hinge 3 can optionally be fixed through one of the holes 17 or 18, to which end the frame 11 has two suitable screw holes 19 one above the other (see FIG. 2).

Figure 4:
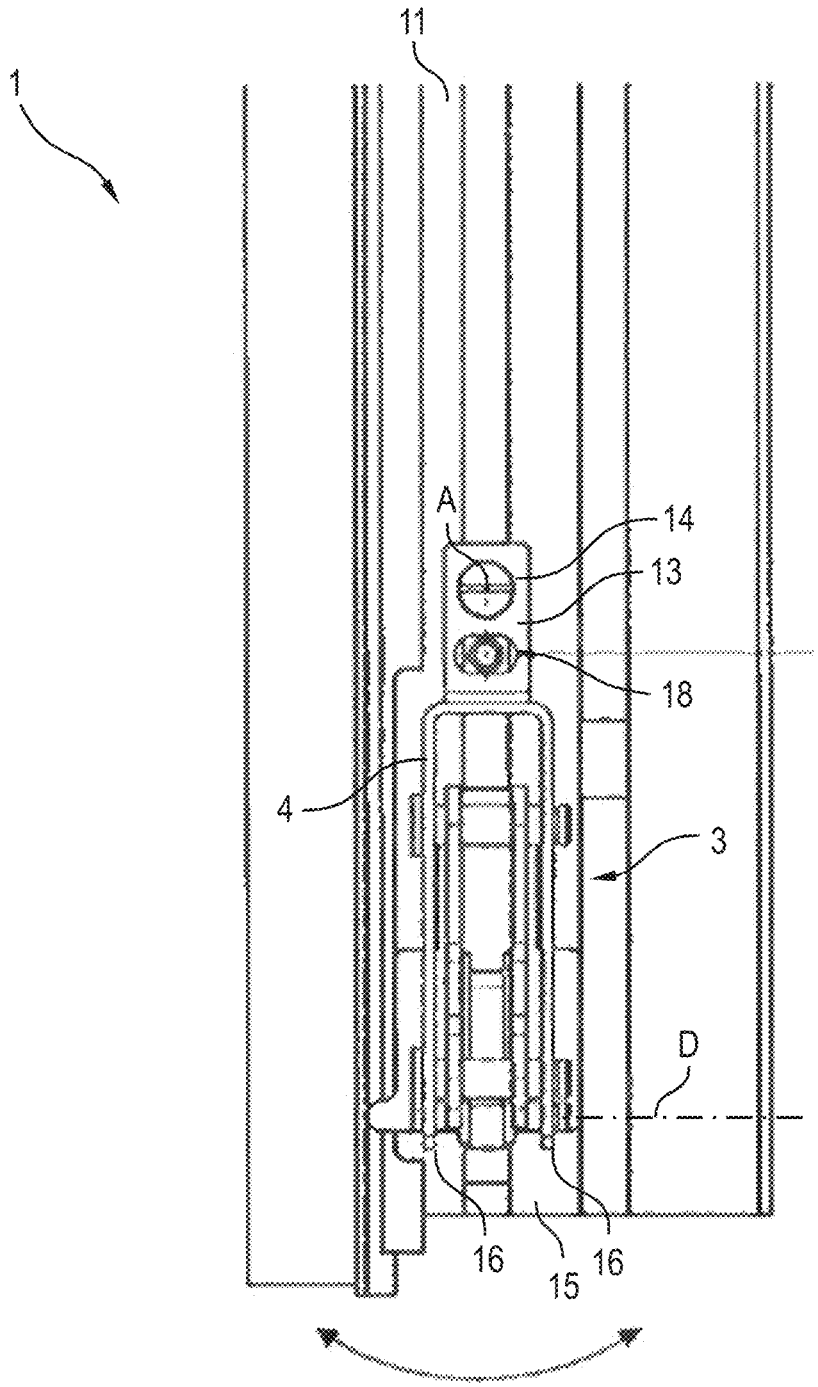
FIG. 4 shows a view from behind of a right-hand hinge inserted into a frame of the oven.

FIG. 4 shows a view from behind of a right-hand, e.g. when viewed from the front, hinge 3 inserted into the frame 11 of the oven 1. The right-hand hinge 3 is freely floatingly suspended on the frame 11 of the oven 1 by means of a screw 14 guided through its round hole 17. As a result it can, as indicated by the double arrow, freely oscillate or swing about the screw axis A of the round hole 17.

Figure 5:
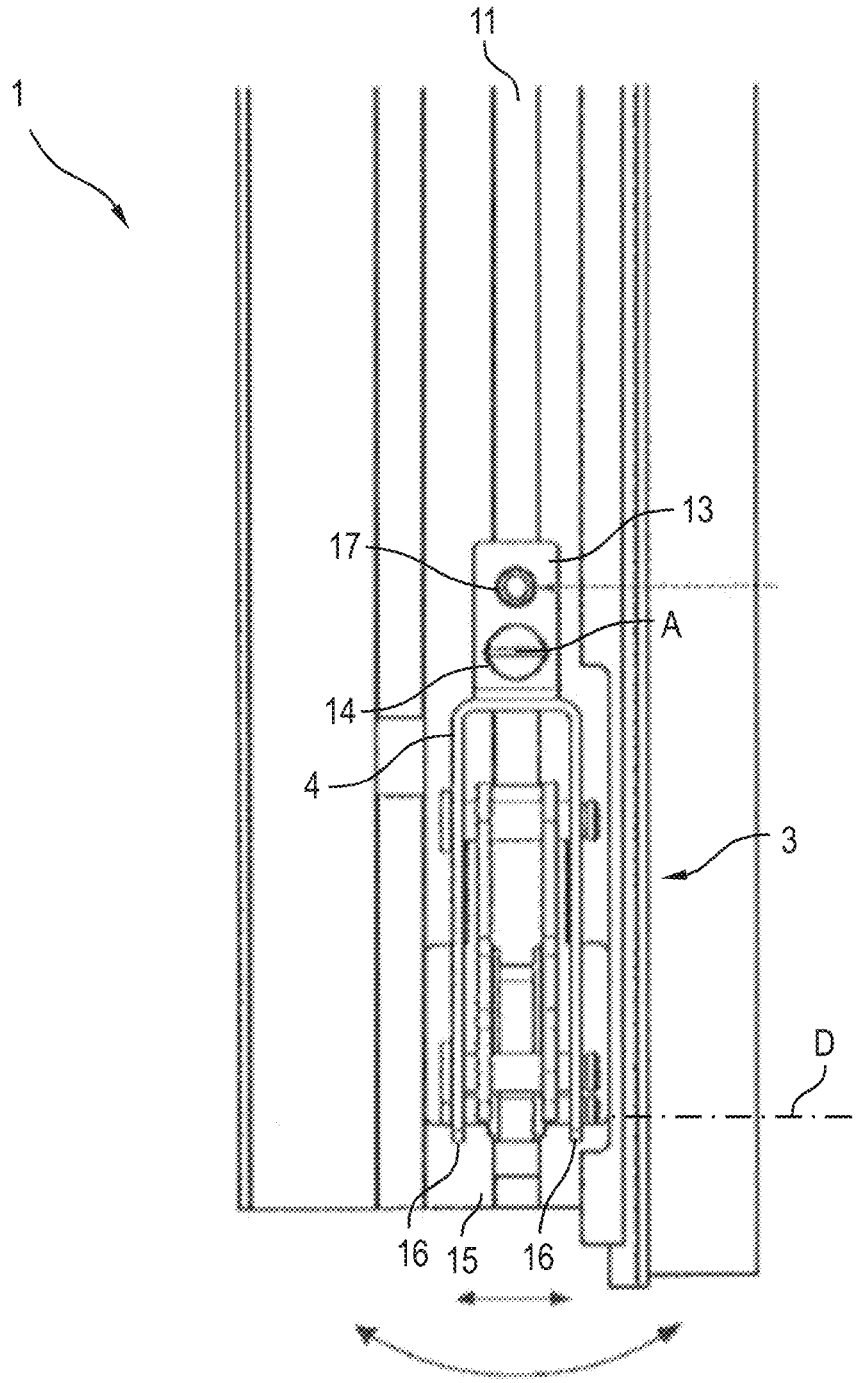
FIG. 5 shows a view from behind of a left-hand hinge inserted into a frame of the oven.

FIG. 5 shows a view from behind of an e.g. left-hand hinge 3 inserted into a frame of the oven. The left-hand hinge 3 is freely floatingly suspended on the frame 11 of the oven 1 by means of a screw 14 guided through its horizontal oblong hole 18. As a result it can, as indicated by the curved double arrow, freely oscillate about the screw axis A of the round hole 17. Furthermore the left-hand hinge 3 can be laterally horizontally displaced, as indicated by the straight double arrow.

Naturally, the present invention is not restricted to the exemplary embodiment disclosed.

In general, "a", "an", etc. can be understood as singular or plural, in particular in the sense of "at least one" or "one or more", etc., provided this is not explicitly excluded, e.g. by the expression "exactly one", etc.

A numerical value can also include the given value as a typical tolerance range, provided this is not explicitly excluded.

The invention claimed is:

1. A household appliance, comprising:

a processing chamber having a loading opening in a front face of the household appliance;

a door; and a plurality of hinges configured to join the door to a remaining structure of the household appliance and to enable the door to horizontally pivot on a first axis to close the loading opening;

wherein each hinge of the plurality of hinges includes a respective hinge casing coupled to the remaining structure of the household appliance by a fixing element passing through an opening in the hinge casing, such that the hinge casing is configured to pivot about a second axis orthogonal to the first axis; and wherein at least one of the hinges is supported on the remaining structure of the household appliance by only the respective fixing element.

2. The household appliance of claim 1, wherein all of the hinges are pivotably suspended on the remaining structure of the household appliance by respective fixing elements each passing through the opening of the respective hinge casing, and wherein all of the hinge casings are fixed to the remaining structure of the household appliance by only the respective fixing elements.

3. The household appliance of claim 1, wherein each hinge casing includes an underside having a slot configured to receive an edge portion of the remaining structure of the household appliance, such that the slot is configured to prevent the underside of the hinge casing from moving toward and away from the front face of the household appliance.

4. The household appliance of claim 3, further comprising a front panel including the edge portion of the remaining structure of the household appliance.

5. The household appliance of claim 1, further comprising a frame, wherein the hinges are joined to the frame.

6. The household appliance of claim 5, wherein each of the fixing elements comprises a respective fixing screw fixed to the frame, and each of the hinges is freely suspended on the respective fixing screw.

7. The household appliance of claim 1, wherein the opening of at least one of the hinge casings comprises a horizontal oblong hole, such that the opening is configured to allow lateral displacement of the hinge relative to the remaining structure of the household appliance.

8. The household appliance of claim 1, wherein the opening of a first one of the hinge casings comprises a horizontal oblong hole, and the opening of a second one of the hinge casings comprises a round hole, such that the opening of the first hinge casing is configured to allow lateral displacement of the first hinge relative to the remaining structure of the household appliance, and the opening of the second hinge casing is configured to limit lateral displacement of the second hinge relative to the remaining structure of the household appliance.

9. The household appliance of claim 1, wherein the opening of one of the hinge casings comprises a round hole, such that the opening is configured to limit lateral displacement of the hinge relative to the remaining structure of the household appliance.

10. The household appliance of claim 1, constructed in the form of a cooking appliance, with the processing chamber being a cooking chamber and the door being a cooking chamber door.

11. The household appliance of claim 1, wherein each hinge casing includes a tab extending vertically from the hinge casing, and the opening of the hinge casing is through the tab.

12. The household appliance of claim 3, wherein the slot is configured such that a gap is formed between the underside of the hinge casing and the edge portion within the slot.

* * * * *